United States Patent [19]

Motoda

[11] 3,948,487

[45] Apr. 6, 1976

[54] CONTROL LEVER MECHANISM IN LIFTING APPARATUS

[76] Inventor: Kenro Motoda, 9-32-4, Kami-Kitazawa, Setagaya, Tokyo, Japan

[22] Filed: Oct. 7, 1974

[21] Appl. No.: 512,889

Related U.S. Application Data

[63] Continuation-in-part of Ser. No. 460,143, April 11, 1974, abandoned, which is a continuation of Ser. No. 356,065, May 1, 1973, abandoned.

[52] U.S. Cl. ..... 254/173 R; 74/543; 254/175.7

[51] Int. Cl.[2] ..... B66D 1/48

[58] Field of Search ..... 254/173 R, 173 B, 175.5, 254/175.7, 146; 212/1, 39 MS, 8 R; 74/471 XY, 471 R, 543, 545, 548

[56] References Cited

UNITED STATES PATENTS

| | | | |
|---|---|---|---|
| 3,390,587 | 7/1968 | Ratliff, Jr. | 74/471 XY |
| 3,507,478 | 4/1970 | Lewis | 254/173 R |

*Primary Examiner*—Robert J. Spar
*Assistant Examiner*—Lawrence J. Oresky
*Attorney, Agent, or Firm*—Wenderoth, Lind & Ponack

[57] ABSTRACT

An control lever mechanism in a lifting apparatus which moves a load in response to a target speed signal, comprises a T-shaped rotary lever and a gear mechanism related to a target speed signal producing device and turned by the lever so that the movement of the load gives no influence on the angle of rotation of the lever.

1 Claim, 4 Drawing Figures

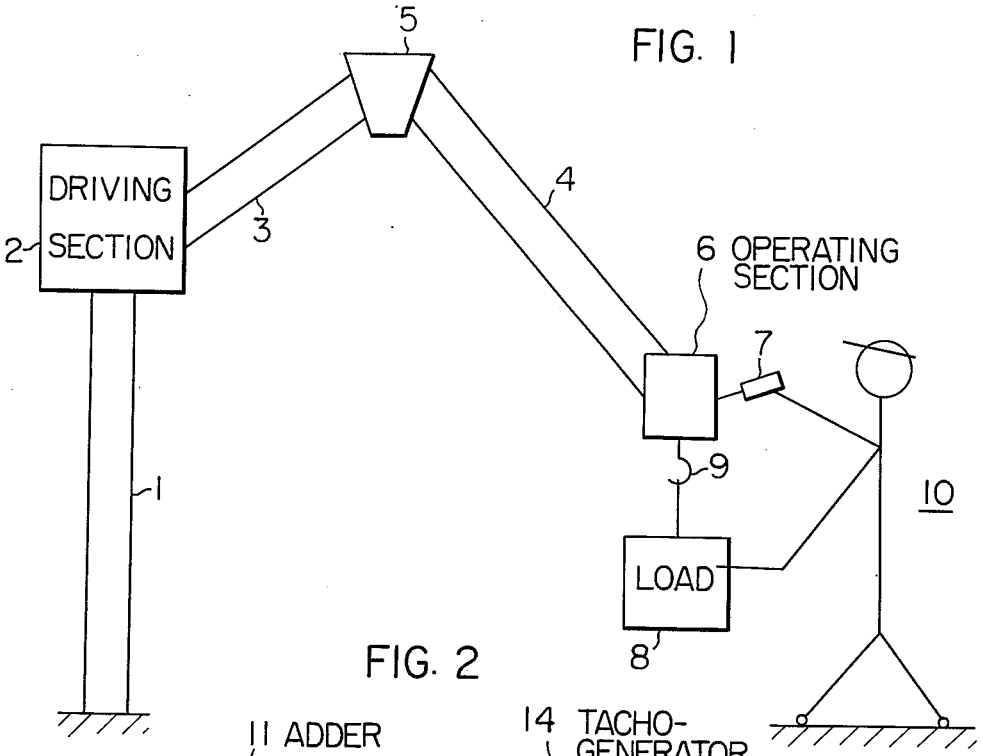
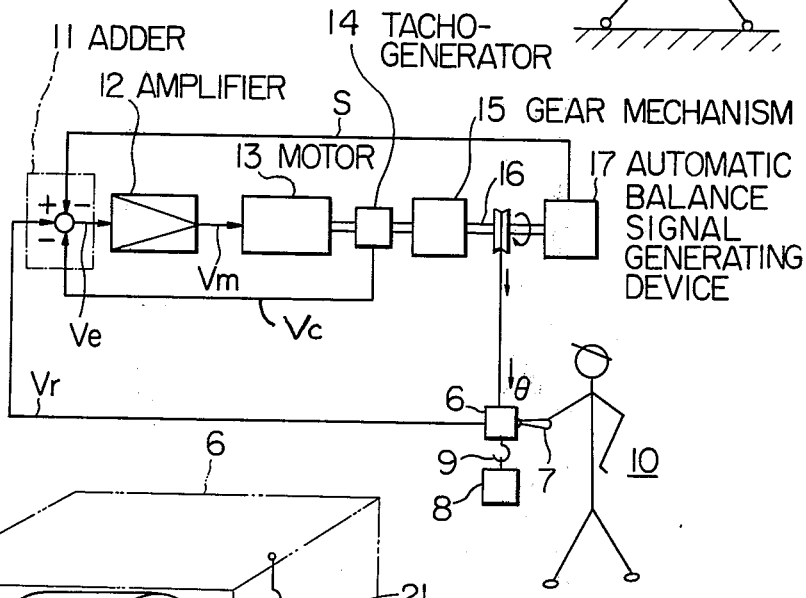
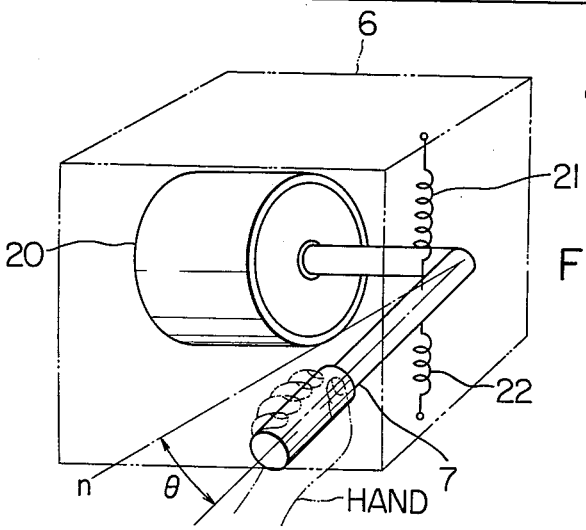
FIG. 3

CONTROL LEVER MECHANISM IN LIFTING APPARATUS

This application is a continuation-in-part of application Ser. No. 460,143, filed on Apr. 11, 1974, now abandoned, which is in turn a continuation of application Ser. No. 356,065 filed on May 1, 1973, now abandoned.

BACKGROUND OF THE INVENTION

This invention relates to a lifting apparatus for lifting heavy materials or loads and more particularly to a control lever mechanism for use in the lifting apparatus.

A conventional lifting apparatus, as is indicated in FIG. 1, comprises: a support 1; a driving section 2 which is provided on the support 1, for driving the apparatus; arms 3 and 4 connected to the driving section 2 through an arm connecting member 5 which is adapted to connect arms 3 and 4 to each other; an operating section 6 which is provided at the end of the arm 4; and a load carrying section, or load carrying member 9 which is adapted to hang a load 8 which is to be moved to a desired place. The operating section 6 has a control lever 7 which is operated by an operator 10.

An electrical arrangement of this conventional lifting apparatus is shown in FIG. 2, and a structure of the operating section 6 including a control lever mechanism is illustrated in FIG. 3.

The electrical arrangement shown in FIG. 2 includes: an adder 11 which carries out addition and subtraction operations of a target speed signal Vr, an automatic balance signal S and a speed feedback signal Vc to apply a driving signal Ve to an amplifier 12; an electric motor 13 which is driven with the aid of a driving signal Vm obtained by amplifying the driving signal Ve by the amplifier 12; a tacho-generator 14 which is connected to a rotary shaft of the motor 13 to produce the speed feedback signal Vc proportional to the rate of rotation of the rotary shaft; a reduction gear mechanism 15; and an automatic balance signal generating device 17 which is connected to an output shaft 16 of the gear mechanism 15 and which, when the vertical movement of the load is stopped, produces the automatic balance signal S which is employed to maintain the load wherever it is stopped.

The operating section 6, as is shown in FIG. 3, comprises a potentiometer 20 for providing the target speed signal Vr corresponding to the vertical displacement (angle $\theta$ of rotation) of the control lever 7 from the neutral position $n$ of the control lever 7, and a pair of springs 21 and 22 to keep the control lever at the neutral position $n$. One end of the upper spring 21 is connected to the control lever 7, while the other end is connected to the upper wall of the operating section 6. Similarly, one end of the lower spring 22 is connected to the control lever, while the other end is connected to the lower wall of the operating section 6.

With the lifting apparatus thus organized, the operator 10 hangs a heavy load 8 on the load carrying member 9 and moves the load vertically to a desired place by operating the control lever 7.

In this connection, it should be noted that the control lever 7 is in the form of the character L and is gripped by the operator's hand in the same manner as a tennis player grips the handle of a racket, as is illustrated FIG. 3.

When the control lever 7 is not operated, the control lever 7 is set at the neutral position $n$ by the mutual action of the upper and lower springs 21 and 22, and accordingly no target speed signal Vr for driving the motor 13 is produced by the potentiometer 20, that is, the target speed is zero. In this case, the automatic balance signal S corresponding to the weight of the load 8 is produced by the automatic balance signal generating device 17, whereby the position of the load 8 is maintained unchanged, that is, the load is not moved downward.

When the control lever 7 is depressed downward for instance, the control lever 7 is turned around the axis of rotation of the potentiometer. As a result, the target speed signal Vr is produced by the potentiometer 20 to drive the motor 13 provided in the driving section 2 (FIG. 1). The rotation of the motor thus driven is transmitted through the gear mechanism 15 to the output shaft 16, whereby the arms 3 and 4 are moved. In this operation, the target speed signal Vr operates to drive the motor 13 so that the operating section 6 is moved downward, that is, the load 8 is moved downward.

The downward movement speed, in this case, is proportional to the rotational angle $\theta$ of the control lever 7. Accordingly, if the control lever is operated to decrease the angle $\theta$ as the load 8 is moved downward, the downward movement speed of the load is decreased with the decreasing of the angle $\theta$. Finally, when the angle $\theta$ becomes zero, that is, the control lever is at the neutral position $n$, the downward movement of the load is stopped, whereupon the load 8 is automatically balanced by the automatic balance signal generating device 17.

The automatic balance signal generating device 17 detects a movement of the load which is caused when the balance is changed by the weight of the load, and converts the movement thus detected into, for instance, a voltage variation which is fed back, as the automatic balance signal S, to the amplifier 12 (adder 11). In this operation, if the balance signal S is increased and descreased respectively by the downward and upward movements of the load 8, the balance signal S corresponding to the variation of weight of the load is produced to achieve the automatic balance operation.

In the case when the operator 10 moves the load upward or downward by operating the control lever 7, it is unnecessary to produce the automatic balance signal S. However, it is necessary that the automatic balance signals S be produced with respect to all of the positions of the operating section 6 ranging from the uppermost position to the lowermost position.

On the other hand, when the control lever 7 is moved upward, a target speed signal Vr corresponding to the angle $\theta$ is produced to move the load 8 upward. Similarly as in the case when the control lever 7 was moved downward, the upward movement of the load is stopped by operating the control lever in such a manner that the angle $\theta$ becomes zero, that is, the automatic balance of the load is obtained.

When the operator 10 removes his hand from the control lever 7, the control lever 7 is set at the neutral position $n$ by the mutual action of the springs 21 and 22, and the lifting apparatus is under the automatic balance condition.

As is clear from the description above, the conventional lifting apparatus forms a feedback control system, and the load is moved upward or downward in accordance with the movement of the hand holding the control lever.

Furthermore, in consideration of simplification in construction, convenience in installation and distance in load movement, the lifting apparatus is in the form of a crane having an arm. Therefore, the lifting arm is less mechanically rigid than machine tools, and accordingly its arm is liable to be deflected by the weight of the load.

In addition, when a heavy load is moved by the lifting apparatus, it is impossible to stop the movement of the heavy load because of its inertia, that is, the heavy load overruns the position where it is to be stopped, even if the control lever is set at the neutral position.

Since the operator operates the lifting apparatus by holding the control lever as indicated in FIG. 3 and observing the position of the load, it is difficult to set the control lever exactly at the neutral position *n*, that is, it is difficult to continuously maintain the target speed signal zero, although it is possible to produce the target speed signal of zero momentarily. Thus, the arm of the lifting apparatus is continuously vibrated, that is, it is difficult to move the load to the desired position, which may result in the occurence of dangerous situations. The vibration of the arm is caused mainly by the operating mechanism of the control lever. Accordingly, the provision of a control lever mechanism which can operate to stably move a heavy load is very much in demand.

SUMMARY OF THE INVENTION

Accordingly, an object of this invention is to provide a control lever mechanism in a lifting apparatus which can operate to stably move a heavy load upward or downward.

Another object of the invention is to provide a control lever mechanism in a lifting apparatus which operates to exactly place a heavy load at a desired position.

A further object of the invention is to provide a simple control lever mechanism in a lifting apparatus which can be readily manufactured.

The foregoing object and other objects of this invention will become more apparent from the following detailed description and the appended claims when read in conjunction with accompanying drawings.

BRIEF DESCRIPTION OF THE DRAWINGS

In the accompanying drawings:

FIG. 1, hereinbefore described, is a schematic diagram illustrating a lifting apparatus to which this invention can be applied;

FIG. 2, hereinbefore described, is a block diagram indicating the control system of the lifting apparatus shown in FIG. 1;

FIG. 3, hereinbefore described, is a perspective view illustrating a conventional control lever mechanism in the lifting apparatus shown in FIG. 1.

DETAILED DESCRIPTION OF THE INVENTION

Figure 4:
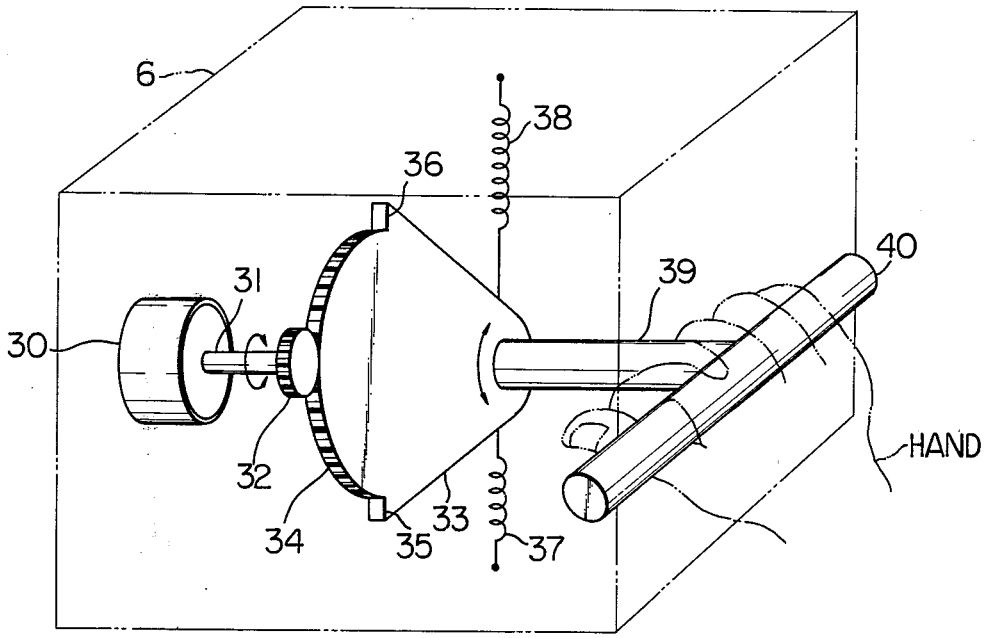
FIG. 4 is also a perspective view illustrating a control lever mechanism, according to this invention, employed in the lifting apparatus shown in FIG. 1.

A control lever mechanism according to this invention, employed in a lifting apparatus, is illustrated in FIG. 4 and includes a potentiometer 30 with a rotary shaft 31 for producing the above-described target speed signal Vr. A driven gear 32 is fixed to the shaft 31 a sector-shaped driving plate 33 has an arc-shaped or sector driving gear 34 34 mechanical stoppers 35 and 36 provided at the two ends of the arc, or the driving gear 34. A spring 37 is connected between one side of the sector-shaped plate 33 and the lower wall of the operating section 6 described above, and a spring 38 is similarly connected between the sector-shaped plate 33 and the upper wall of the operating section. A driving shaft 39 is fixed to the sector-shaped plate 33, and a lever 40 is connected to the driving shaft 39, the lever 40 and the shaft 39 forming one unit in the form of the character T. The function of the pair of the springs 37 and 38 is to set the control lever mechanism at the neutral position thereof, as described above with reference to springs 21 and 22.

It should be noted that the T-shaped unit 39 and 40 (hereinafter referred to as a T-shaped rotary lever) is gripped by the operator's hand in such a manner that the intersection of the shaft 39 and the lever 40 comes almost in the center of the operator's palm, as is illustrated in FIG. 4.

When the operator turns the T-shaped rotary lever 39 and 40 by his hand clockwise or counterclockwise as directed, the sector-shaped plate 33 is also turned, and the driven gear 32, and the rotary shaft 31, is turned through the driving gear 34 provided on the sector-shaped plate 33, as a result of which a target speed signal Vr such as described above is produced by the potentiometer 30. The target speed signal Vr is proportional to an angle $\theta$ of rotation of the lever 40.

For instance, a load supported on the load carrying member 9 (FIG. 1) is moved downward by turning the lever 40 clockwise and is moved upward by turning the lever 40 counterclockwise. When the operator removes his hand from the lever 40, the sector-shaped plate 33 is balanced by the mutual action of the springs 37 and 38, that is, it is set at the neutral position. Accordingly, the target speed signal Vr becomes zero and the movement of the load is stopped.

As is apparent from the above description, according to this invention, the target speed signal Vr is obtained by turning the lever which is held by the operator's hand as illustrated in FIG. 4, and he can change the angle of rotation of the lever based on his sight and the positional sense of his hand. Accordingly, the movement of the load does not directly influence the angle of rotation of the lever. Thus, it is possible to stably move the load upward or downward and to place the load exactly at a desired position.

The potentiometer for producing the target speed signal may be replaced with a synchromotor or an inductosyn.

What is claimed is:

1. In a lifting apparatus for moving a load, said lifting apparatus being of the type including a crane type arm connected to and movably operable by a driving section, an operating section connected to said crane type arm, a load carrying member attached to said operating section, and a control lever mechanism mounted in said operating section and including a movable lever and means for generating a target speed signal representative of movement of said lever and for supplying said signal to said driving section, thereby operating said driving section to move said crane type arm; the improvement mechanism said control lever mechanism mechanism a potentiometer having a rotary shaft, said potentiometer comprising means for generating said target speed signal upon rotation of said rotary shaft;

a driven gear fixed to said rotary shaft;

a sector-shaped driving plate having a sector gear in meshing engagement with said driven gear;

a driving shaft fixed to said driving plate and extending outwardly therefrom;

a lever attached to an end of said driving shaft, such that said driving shaft and said lever form a T-shaped rotary lever;

whereby clockwise or counterclockwise rotation by hand of said T-shaped rotary lever results in a corresponding rotation of said driving plate and respective counterclockwise or clockwise rotation of said driven gear and said rotary shaft of said potentiometer, thereby generating said target speed signal;

a first spring connected to a first side of said driven plate; and a second spring connected to a second side of said driven plate;

said first and second springs comprising means, upon release of said T-shaped rotary lever, for returning said driven plate to a balanced null position whereat said target speed signal is zero.

* * * * *